US007455262B2

(12) United States Patent
Sava

(10) Patent No.: US 7,455,262 B2
(45) Date of Patent: Nov. 25, 2008

(54) PRINTER/PLOTTER ROLLER ADAPTOR SYSTEM

(75) Inventor: Dennis S. Sava, Buena Park, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 452 days.

(21) Appl. No.: 11/255,345

(22) Filed: Oct. 21, 2005

(65) Prior Publication Data

US 2007/0125903 A1 Jun. 7, 2007

(51) Int. Cl.
*B65H 75/14* (2006.01)

(52) U.S. Cl. ..... 242/612; 242/609.2; 242/599.2

(58) Field of Classification Search ..... 242/612, 242/613.1, 613.4, 614.1, 609.1–609.3, 599.2–599.4
See application file for complete search history.

(56) References Cited

U.S. PATENT DOCUMENTS 509,159 A * 11/1893 Giles ..... 242/573.5
1,118,860 A * 11/1914 Howarth ..... 242/599.4
1,180,955 A * 4/1916 Stuck ..... 242/609
1,525,751 A * 2/1925 Lamotte ..... 242/573.1
1,557,700 A * 10/1925 Jaderlund ..... 242/599.2
1,803,193 A * 4/1931 Kennedy ..... 242/573.6
1,823,164 A * 9/1931 Pope ..... 242/599.2
1,948,430 A * 2/1934 Robinson ..... 242/608.4
5,469,619 A 11/1995 Rench ..... 29/895.2
5,911,382 A 6/1999 Wilson ..... 242/419.6
6,390,428 B1 * 5/2002 Oshima ..... 248/266

* cited by examiner

*Primary Examiner*—Sang Kim
(74) *Attorney, Agent, or Firm*—Louis L. Dachs

(57) ABSTRACT

An adapter assembly for paper roll holders in a printer/plotter comprising ring shaped spacers that increase the diameter of the existing end mounted surfaces of the holder such that a larger size paper roll and be installed.

4 Claims, 4 Drawing Sheets

FIG. 1
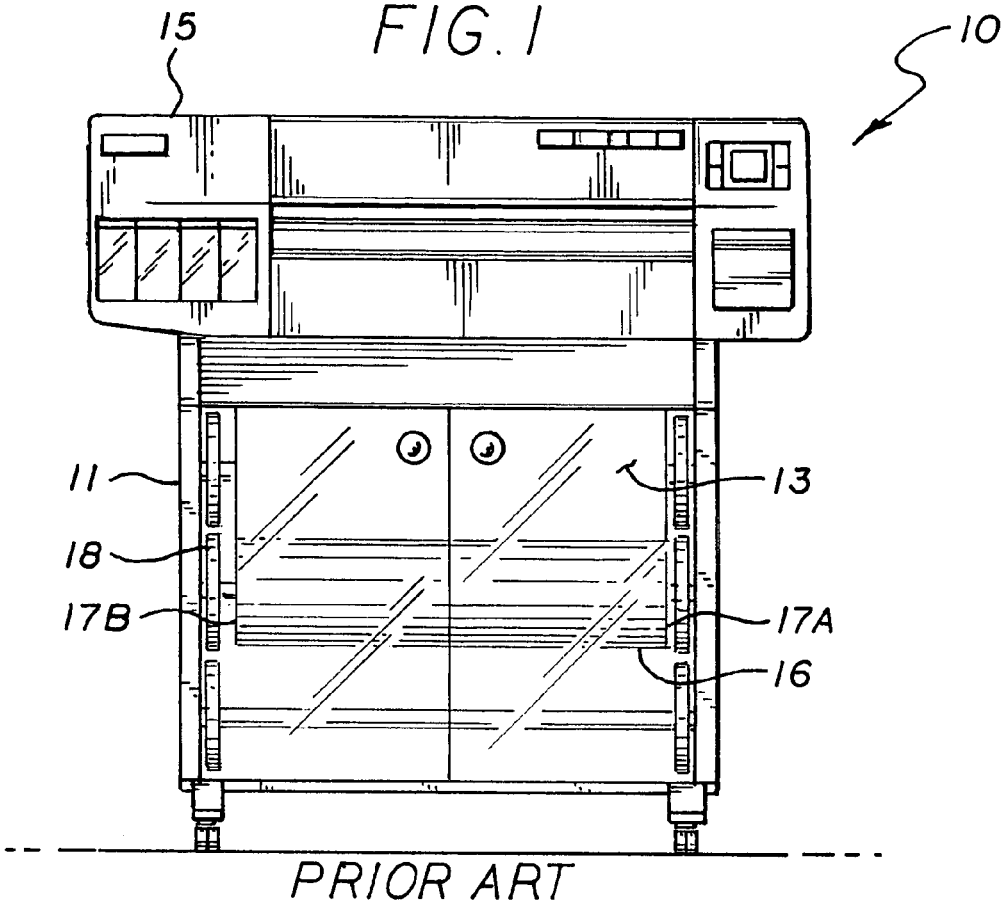
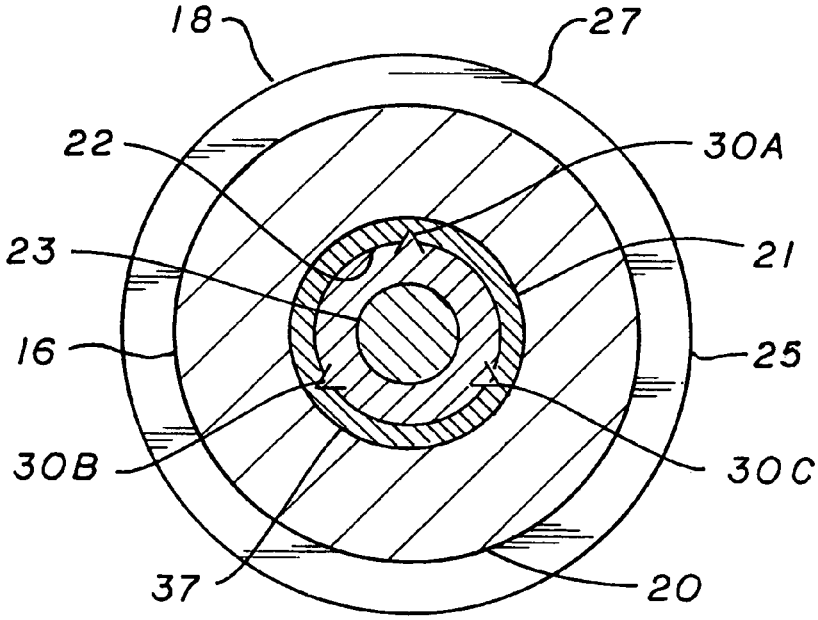
FIG. 3

FIG. 5
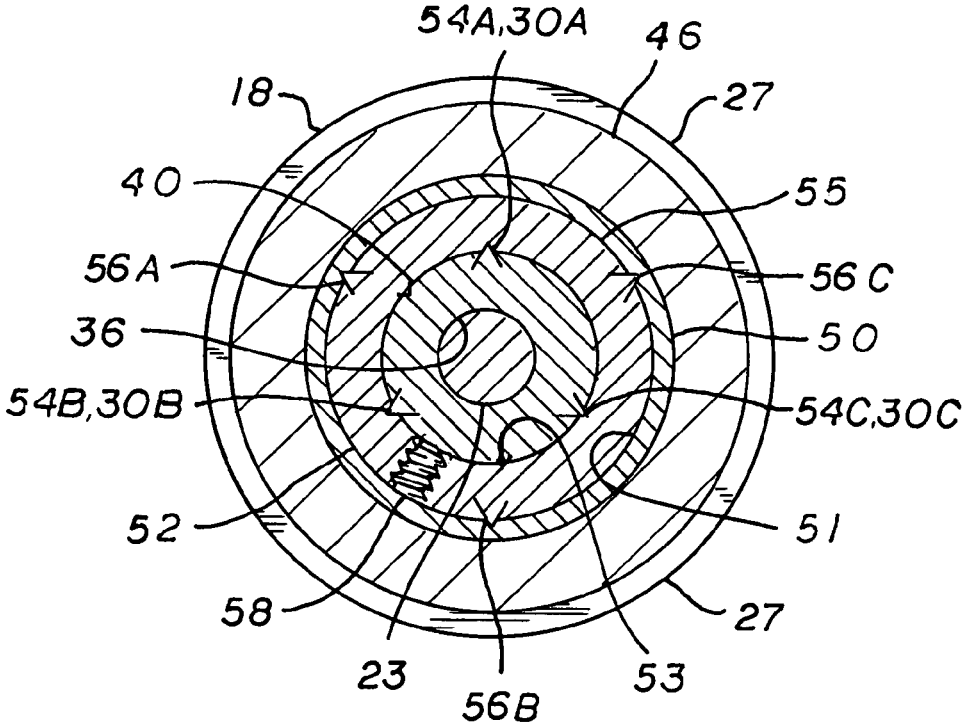
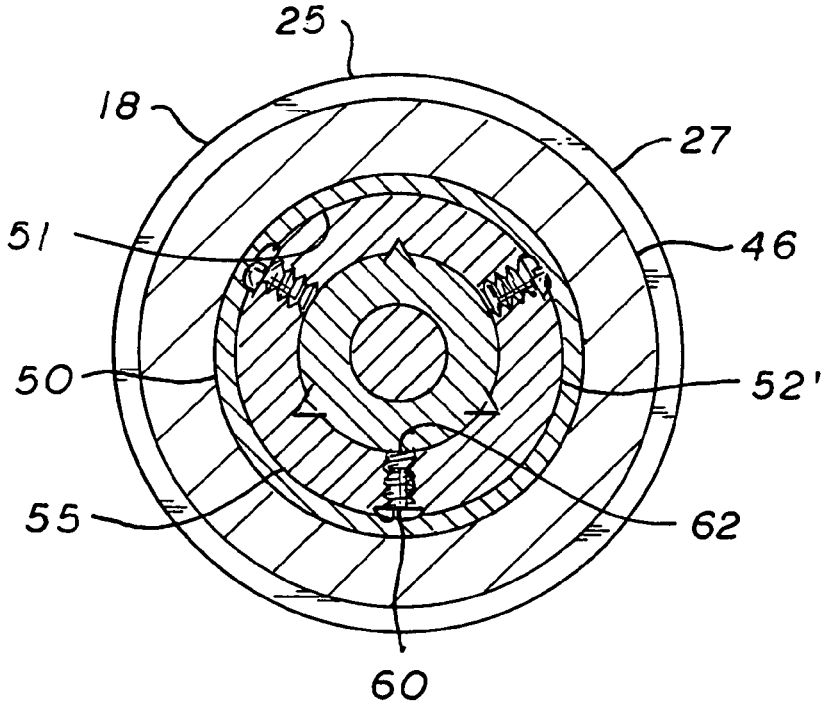
FIG. 6

PRINTER/PLOTTER ROLLER ADAPTOR SYSTEM

BACKGROUND OF THE INVENTION

1. Field of the Invention

The invention relates to the field of printer/plotters and, in particular, to an adaptor system that allows a printer/plotter designed to use one size of paper roll to use a larger roll of paper.

2. Description of Related Art

A number of printer/plotters are designed to use only one size of paper roll. If high utilization of the printer/plotter occurs, there is an economic impact. For example, large capacity paper rolls (500 feet of paper) on a per foot cost basis can save 55 percent over 150 foot capacity rolls. Furthermore, loading a new paper roll is a somewhat time consuming operation.

U.S. Pat. No. 5,911,382 Auxiliary Printing Media Roll Holder For Printer/Plotters by B Wilson discloses a paper roll holder adapted to hold a large paper roll that can be inserted in to a printer/plotter to replace the lower capacity holder. While this approach solves the problem it is an expensive piece of equipment and time consuming to install.

Thus, it is a primary object of the invention to provide to provide a device that will allow a printer/plotter to utilize a larger capacity paper roll.

It is another primary object of the invention to provide a device that will allow a printer/plotter to utilize a larger capacity paper roll that is easy to install.

SUMMARY OF THE INVENTION

The invention is an adapter assembly for paper roll holders used in a printer/plotter that can only use a first size of paper roll and which allows the holder to accommodate a second larger size paper roll. The first paper roll includes a first tube having a first internal bore and the second paper roll includes a second internal bore. The paper roll holder of the printer/plotter includes spaced apart end members connected by a shaft. Each of the end members includes an external surface for mounting the ends of internal bore of the first size paper roll and incorporates a first retainer on the surface to prevent relative rotation there between. The adaptor system allows the second larger paper roll to be mounted to the holder. The adapter system consists of a spacer mountable to each of the spaced apart mounting members.

In detail, each spacer includes a ring shaped spacer having an internal bore, the internal bore adapted to mate with the external surface of the end members of the holder and an external surface adapted to mate with the second internal bore of the second larger paper roll. A second retainer is provided for engaging the first retainer on the external surfaces of the end members. A third retainer is provided on the external surface of the cylindrical shaped member for engaging the second bore of the second larger paper roll. Preferably, a locking device is provided for securing the cylindrical shaped member to the end members.

The first retainer is preferably first retainer are plurality of tapered triangular shaped protrusions; the second retainer is a plurality of tapered triangular shaped grooves, and the third retainer are also a plurality of tapered triangular shaped protrusions. An alternate version of the third retainer is a plurality of set screws space about the periphery of the cylindrical shaped member.

Thus to install the spacers, all that is necessary is to remove one of the end members from the paper holder, remove the smaller paper roll and install a spacer on each end member of the holder and secure it thereto by means of the locking device. Thereafter, the second larger paper roll is installed such that one end engages the still attached end member with the second third retainer engaging the second roller and reinstalling the removed end member such that at it engages the other end of the second larger paper roll.

The paper rolls all have a cardboard cylinder upon which the paper is rolled. Thus the first and third retainers engage and distort the cardboard as the rolls are installed preventing relative rotation there between.

The novel features which are believed to be characteristic of the invention, both as to its organization and method of operation, together with further objects and advantages thereof, will be better understood from the following description in connection with the accompanying drawings in which the presently preferred embodiments of the invention are illustrated by way of examples. It is to be expressly understood, however, that the drawings are for purposes of illustration and description only and are not intended as a definition of the limits of the invention.

BRIEF DESCRIPTION OF THE DRAWINGS

FIG. 1 is a front view of a conventional prior art printer/plotter utilizing a small capacity paper roll.

FIG. 3 is a cross-sectional view of the paper roll holder shown in FIG. 2 illustrating the device used to engage the end of the paper roll.

FIG. 5 is an enlarged cross-sectional view of the spacer device shown in FIG. 4.

FIG. 6 is an enlarged cross-sectional view of a second version of the spacer device.

DESCRIPTION OF THE PREFERRED EMBODIMENT

Figure 2:
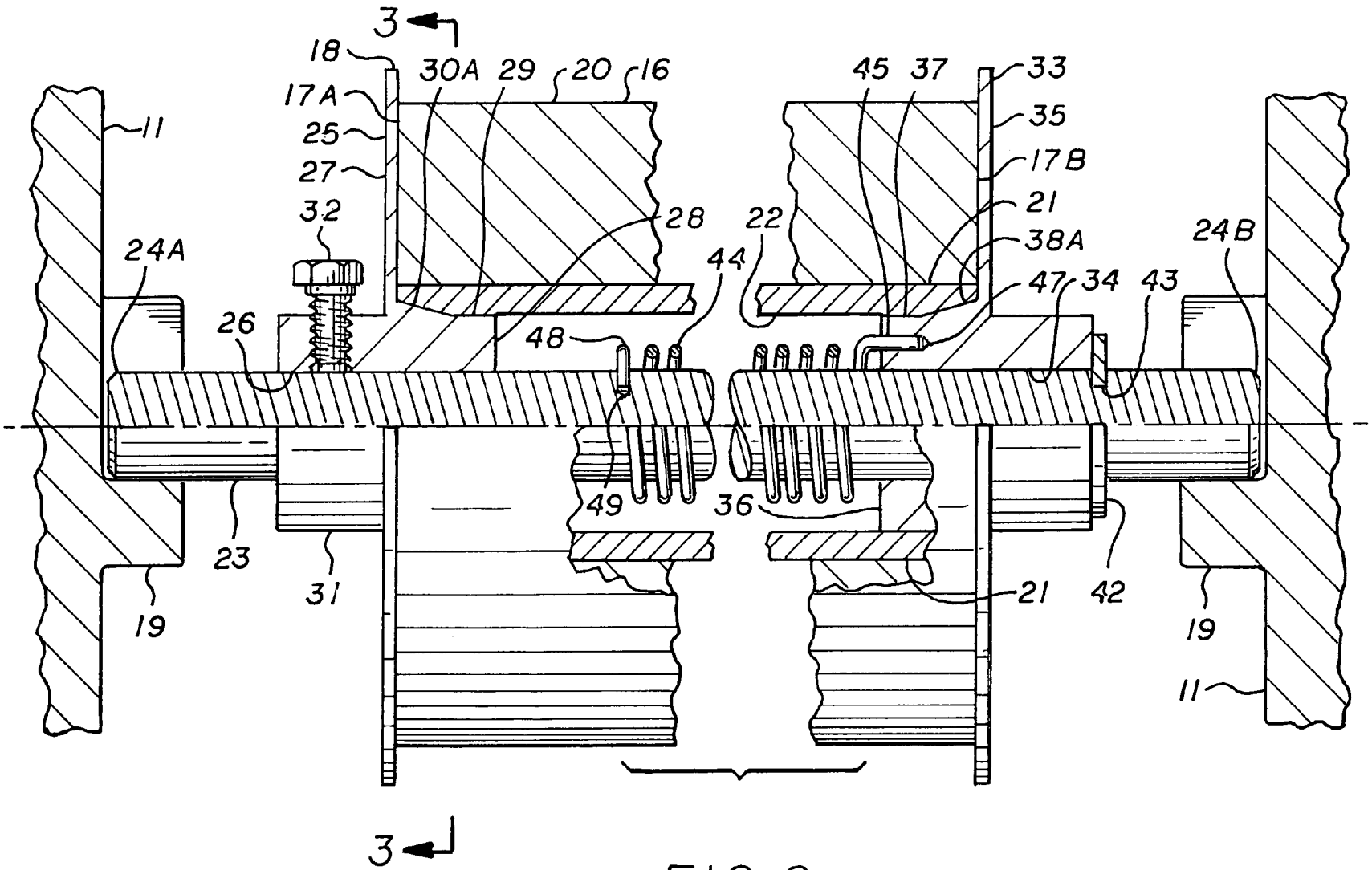
FIG. 2 PRIOR ART
FIG. 2 is a cross-section view of the paper roll holder shown in FIG. 1.

FIGS. 1 and 2, illustrate a typical prior art large capacity printer/plotter, generally referred to by numeral 10. The printer/plotter 10 includes a housing 11 having a paper storage compartment 13 and a printing assembly 15. As illustrated, the model shown is a Hewlett-Packard Corporation (HP) 1055CM. A paper roll 16, having ends 17A and 17B is shown mounted on a holder 18 supported by the printer/plotter structure 19. The paper roll 16 comprises paper 20 rolled up on a hollow cardboard tube 21 having an internal bore 22. In operation, the paper 20 is unwound from the roll 16 and fed upward to printing assembly 15.

Referring to FIGS. 2 and 3, the holder 18 includes a shaft 23 having first and second ends 24A and 246 The end 24A includes an end plate assembly 25 having a bore 26 there through mounted near the end 24A of the shaft 23. The end plate assembly 25 includes a disc shaped paper roll retainer 27 having a paper mounting member 28 that extends inward. The member 28 has an external surface 29 that includes three triangular shaped protrusions 30A, 30B and 30C adapted to mate with the external bore 22 of the tube 21 of the paper roll 16. A mounting bushing 31 extends outward from the end pate assembly 25 and incorporates a set screw 32 for securing the end plate assembly 25 to the shaft 23.

Mounted near the second end 24B of the shaft 23 is a removable end plate assembly 33 having an internal bore 34 that slidably engages the shaft 23. The end plate assembly 33 includes a second disc shaped paper roll retainer 35. The assembly 33 further includes an inward facing mounting member 36. The member 36 includes an external surface 37 having three triangular shaped protrusions 38A. 38B and 38C (protrusions 38B and 38C are shown in FIG. 5) adapted to mate with the internal bore 22 of the tube 21 of the paper roll 16. A snap ring 42 is installed in a groove 43 in shaft 23 for securing the end plate assembly 34 in place. A coil spring 44 has one end 45 inserted into a hole 47 in the member 36 and a second end 48 installed in a hole 49 in the shaft 23. This spring 44 bias the end plate assembly 33 to remain rotationally aligned with the shaft 23.

To secure the paper roll 16, the end plate 33 is removed from the shaft 23, the paper roll 16 is slid over the shaft until the end 17A contacts the protrusions 30A-30C on the surface 29 of the member 28 engage the bore 22 of the cardboard tube 21. The roll 16 is pushed toward the end plate assembly 25, which will cause the protrusions 30A-30C to bite into the cardboard tube preventing differential rotation there between as the end 17A abuts the disc 27. The end plate assembly 33 is then installed on the shaft 23 and pushed toward the end-plate assembly 25 until the protrusions 38A-38C fully engage the cardboard tube 21. The end 46 of the spring 44 is inserted into the hole 45. The snap ring 42 is then installed into the groove 43 in the shaft 23 securing the roll 16 to the holder 18. Note that the protrusions deform the soft cardboard of the tube 21 forming grooves therein. The completed assembly is then installed into the printer.

Figure 4:
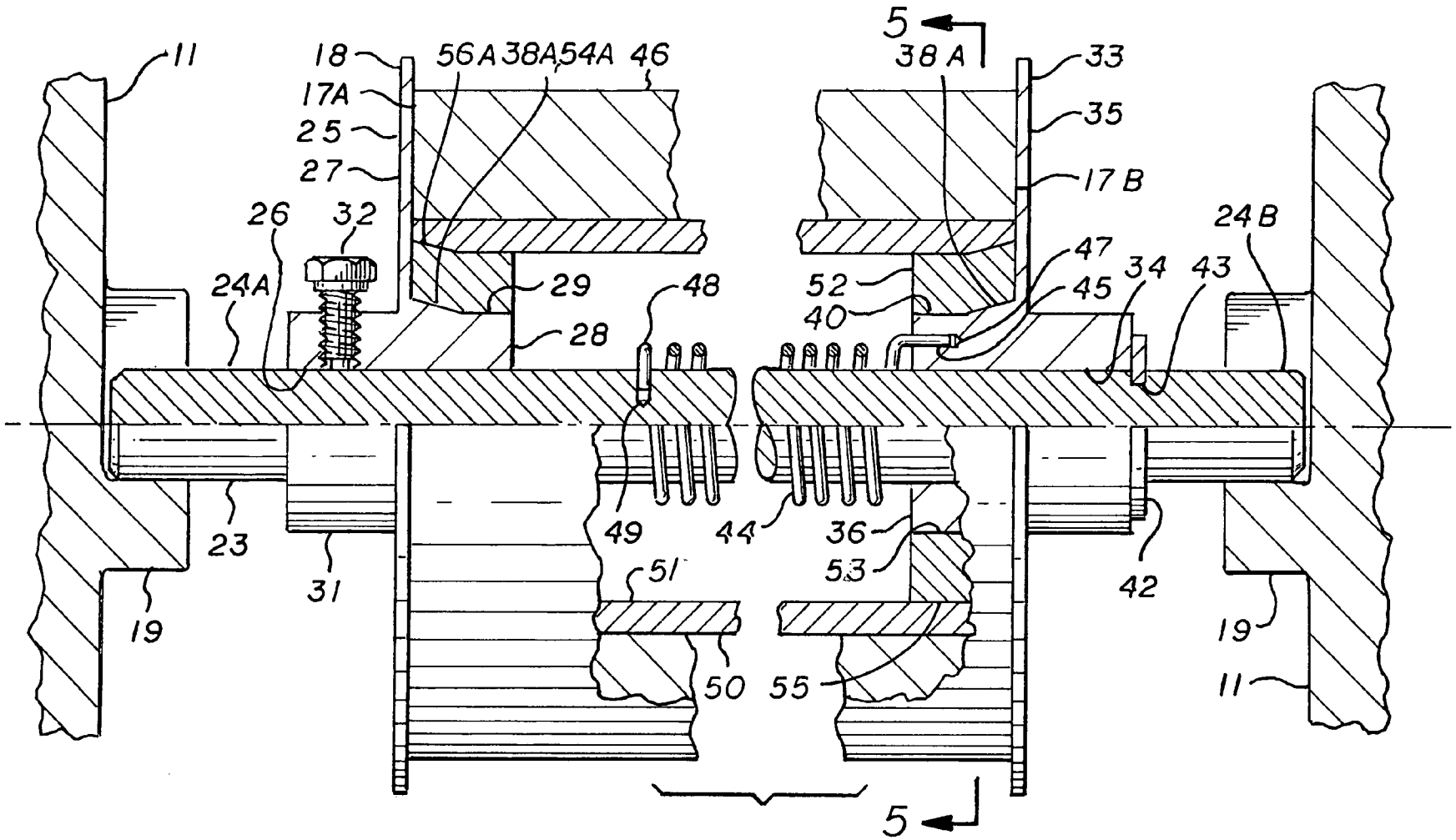
FIG. 4 is a cross-section view of the paper holder shown in FIG. 2 with the spacer device, which allow the use of increased capacity paper rolls.

Now such a design is limited to a single size paper roll. Referring to FIGS. 4 and 5, the subject invention is a roller adapter system that can be installed on the holder 18 to allow it to mount a paper roll 46 having a cardboard tube 50 with an internal bore 51 larger than the bore 22 of the cardboard tube 21 of the paper roll 16. The adapter system includes a spacer 52, which has a ring shape having an internal bore 53 adapted to slidably engage the surfaces 29 of the member 28. The spacer 52 further includes three triangular shaped grooves 54A, 54B and] 54C adapted to mate with the protrusions 38A-38C and the external surface 40 of the member 36. The external surface 55 of the spacer 52 includes three equally spaced triangular shaped protrusions 56A. 56B and 56C. The external diameter of the surface 55 is adapted to mate with the larger bore 51 of the tube 50. A set screw 58 on the device allows it to be secured to either the member 28 or 36. A second spacer 50 is installed on the external surface 29 of the member 28, in an identical manner with the protrusions 38A-38C mating with the grooves 54A-54C.

Installation is simple, which is accomplished removing the end plate assembly 31 and roll 16 from the shaft 23 and removing any paper roll 16. Thereafter, a spacer 52 is installed on both the member 28 and 36 such that the grooves mate with the protrusions of the members 28 and 36 and secured thereto by the set screw 58. Thereafter the larger size roll 46 can be installed as in the previous example.

Referring to FIG. 6 a second version of the spacer, now indicated by numeral 52', is identical except for the elimination of the external protrusions 56A-56C. Here a series of screws 60 installed in threaded holes 62 are installed about the circumference of the external surface 55 can be individually adjusted to match any discrepancies in the internal bore the cardboard tube.

Thus it can be seen that this simple spacer system can be used to allow the use of any size paper roll, the only limitation being the space within the printer/plotter. Additionally, while triangular shaped protrusions used by HP are typical, other methods are applicable and can be used with this invention.

While the invention has been described with reference to particular embodiments, it should be understood that the embodiments are merely illustrative as there are numerous variations and modifications, which may be made by those skilled in the art. Thus, the invention is to be construed as being limited only by the spirit and scope of the appended claims.

INDUSTRIAL APPLICABILITY

The invention has applicability to the printer/plotter manufacturing industry.

The invention claimed is:

1. An adapter assembly for paper roll holders in a printer or plotter wherein the holder is adapted to accommodate one size of paper roll having a first internal bore for attaching to spaced apart end members mounted to a support shaft, the end members having a plurality of triangular shaped protrusions for engaging the internal bore of the paper roll to prevent relative rotation there between, the adapter assembly for allowing a larger paper roll having a second larger internal bore, the adapter assembly consisting of a device mountable to each of the spaced apart end members, the device comprising;

a cylindrical shaped spacer having an internal bore and an external surface, said internal bore of said spacer having a diameter such that said spacer mates with the end member and said external surface having a diameter such that said spacer mates with the second internal bore of the larger paper roll;

a plurality of tapered triangular shaped grooves mounted on said internal bore of said spacer for engaging the plurality of triangular shaped protrusions on the end member such that rotation there between is prevented; and protrusions mounted on said external surface of said cylindrical shaped spacer for engaging the internal bore of the larger paper roll.

2. The adapter assembly as set forth in claim 1 including fasteners to secure said spacer to said end members.

3. The adapter assembly as set forth in claim 2 wherein said protrusions are a plurality of tapered triangular shaped protrusions.

4. The adapter assembly as set forth in claim 2 wherein said protrusions are a plurality of set screws space about the periphery of said spacer.

* * * * *